United States Patent [19]

Wolff

[11] 4,041,708

[45] Aug. 16, 1977

[54] METHOD AND APPARATUS FOR PROCESSING VAPOROUS OR GASEOUS FLUIDS

[75] Inventor: Otto E. Wolff, Weston, Mass.

[73] Assignee: Polaroid Corporation, Cambridge, Mass.

[21] Appl. No.: 747,716

[22] Filed: Dec. 6, 1976

Related U.S. Application Data

[62] Division of Ser. No. 402,315, Oct. 1, 1973.

[51] Int. Cl.[2] ..... F01K 25/04; F01K 25/06

[52] U.S. Cl. ..... 60/649; 60/673

[58] Field of Search ..... 60/649, 673

[56] References Cited

U.S. PATENT DOCUMENTS 3,861,148 1/1975 Bailey et al. ..... 60/673

*Primary Examiner*—Allen M. Ostrager
*Attorney, Agent, or Firm*—David R. Thornton

[57] ABSTRACT

A gaseous fluid is combined with a liquid to form a transient foam for processing the fluid as by compression, expansion, condensation, heat exchange or chemical reaction.

7 Claims, 12 Drawing Figures

METHOD AND APPARATUS FOR PROCESSING VAPOROUS OR GASEOUS FLUIDS

This is a division of application Ser. No. 402,315, filed Oct. 1, 1973.

BACKGROUND

This invention relates to apparatus and methods for processing a gaseous fluid while it is combined with a liquid in a transient foam. Processes that can be practiced on the foamed fluids include compression, expansion and condensation of the gaseous fluid; and heat exchange and chemical reaction with the gaseous fluid.

The foam state provides an enormous surface-to-volume ratio between the gaseous fluid and the liquid. Further, the liquid has a relatively large heat capacity. These properties of the foamed fluids result in almost instantaneous heat exchange between the gaseous fluid and the foamed liquid, and make possible the essentially isothermal compression and expansion of the gaseous fluid. Further, the foam has many times the density of the gaseous fluid alone, and hence can be processed with rotating equipment having a corresponding reduction in size, speed and cost as compared to equipment for processing the gas by itself.

A principle application of the invention relates to the control of the temperature of a gaseous fluid during compression and during expansion. More particularly, this aspect of the invention provides essentially isothermal compression and isothermal expansion of a gaseous fluid. To these ends, the invention teaches that a gaseous fluid be compressed, and conversely expanded, while it is foamed with a liquid. Heat rapidly transfers between the gaseous fluid and the foamed liquid during either process so that the gas experiences essentially no temperature change. Hence, both operations can be essentially isothermal.

More generally, the liquid foam can limit the temperature change of the gaseous fluid during compression and during expansion to any desired degree between the temperatures resulting from an isothermal process to a normal adiabatic process. Further, foam of initially supercooled liquid can chill the gas sufficiently to offset heat of compression so that after compression the gas is cooler than prior to contact with the liquid. Thus, this aspect of the invention in its broad scope relates to controlling the temperature of a gaseous fluid during compression and during expansion by containing the fluid in a liquid foam. However, for clarity of description this aspect of the invention is described principally with specific application to providing substantially isothermal processes.

PROBLEMS AND PRIOR ART

Advantages of processing gases isothermally, i.e. at constant temperature, are well known. These include higher efficiencies in the operating cycle of heat engines, and other economies both in equipment and in operation. However, isothermal processing has been largely a theoretical concept, and not realized in commercial practice. This is because prior gas-processing apparatus lacks efficient means to transfer heat to or from the gas, whichever the process requires. This deficiency constrains prior isothermal compressors, for example, to compress the gas slowly, as required to allow the heat of compression to transfer to a heat-absorbing mechanism.

Among the prior art efforts to approach isothermal compression are the teachings in U.S. Pat. Nos. 2,451,873 of Roebuck; 2,470,655 of Shaw; and 3,109,297 of Rinehart. However, it is considered that these patents have, at best, achieved only limited progress in controlling the increase in gas temperature.

Accordingly, it is an object of this invention to provide a method and apparatus for processing a gaseous fluid while configured with a higher surface-to-volume ratio than previously available.

Another object of the invention is to provide a method and apparatus for processing a gaseous fluid while in a closer heat exchange relation with a material of high heat capacity than heretofore available.

A further object of the invention is to provide a method and apparatus for the improved control of the temperature change in a gaseous fluid during compression, and during expansion.

Another object of the invention is to provide a method and apparatus for compressing a gas with a selected control of the gas temperature from between an overall temperature reduction to an adiabatic increase.

A corresponding object of the invention is to provide a method and apparatus for expanding a gas with selected control of the gas temperature from between an overall temperature increase to an adiabatic decrease.

A more specific object of the invention is to provide a method and apparatus for the essentially isothermal compression, and isothermal expansion, of a gaseous fluid.

A further object is to provide a method and apparatus for the essentially isothermal compression of gas with the removal of water and like vapors from the gas.

It is also an object of the invention to provide a method and apparatus for the commercial realization of a thermodynamic machine, e.g. refrigerator, heat pump, heat engine, or thermodynamic energy store, operating with a cycle having an essentially isothermal volume change, i.e. compression and/or expansion.

Another object of the invention is to provide a method and apparatus for the commercial realization of a heat engine operating with a power cycle having isothermal compression and regenerative heating.

Still another object of the invention is to provide a method and apparatus for the commercial realization of a heat engine operating with a near Carnot cycle.

Other objects of the invention will in part be obvious and will in part appear hereinafter.

The availability of practical isothermal processes as this invention can make possible has many applications of potentially commercial importance. It can make possible significant savings in the initial cost of gas compressing equipment by reducing the size and power requirements, eliminating the need for intercoolers, reducing the number of stages, and reducing heat exchanger sizes. Under certain conditions, the required compressor power is cut in half.

Further, many refrigeration processes involve the use of compressors. Vapors as used for modern refrigerants have the desirable quality of condensing and evaporating at constant temperatures, which makes high cycle efficiencies possible. However, the conventional compression of refrigerants is adiabatic and hence superheats the vapors. The adoption of isothermal compression can reduce the degree of superheating, and thereby reduce the power requirements; it can also reduce the amount of heat which needs to be dissipated through the heat exchanger. Perhaps a more important consequence of isothermal refrigerant compression in accordance with the invention is the direct liquefaction of the refrigerant in the foam. This eliminates the conventional condenser.

The availability of an isothermal compression process can also enhance the practicality of air cycle refrigeration. In this cycle, compression of air is followed by recovery of some of the energy by expansion. The cool air from the engine is available for refrigeration. While not as efficient as the vapor cycle, such a cycle has advantages of simplicity, safety, and ability to produce lower temperatures.

In addition to the foregoing, the use of isothermal compression in place of the adiabatic process conventionally employed can make the efficiency of gas turbines competitive with that of other prime movers. The isothermal compression reduces input power requirements, and the low end temperature of the compressed air allows almost complete recovery of available heat from the exhaust gas in a counterflow exchanger. Such recovery can increase thermal efficiency 35% at turbine inlet temperatures of 1200° F, and 14% at 2000° F. Moreover, a closed cycle machine of this type and employing this invention does not require a precooler before the compressor other than the exhaust heat exchanger; heat rejection from the cycle takes place solely through the foam liquid.

In view of the fact that a large part of the power output from a gas turbine is consumed in driving the gas compressor, an efficient way to handle peak loads would be to store the compressed air during off-peak operation and use it in separate power units on demand. However, the storage of adiabatically compressed gas is wasteful of heat and uneconomical. On the other hand, the heat loss from isothermally compressed gas, which this invention makes possible, is minimal. Accordingly, its storage under constant pressure can allow appreciable savings in capital investment. For instance, underground storage of gas under a 350 foot head of water could store two kilowatt hours of energy for each cubic yard.

Another feature of the invention is that the high surface-to-volume ratio of gaseous fluid in a liquid foam makes such a foam attractive as a mechanism for removing moisture and other vapors which may be dissolved in the gas. The removal can be achieved by condensation of the vapor from a supercooled foam liquid, or absorption by a dessicating salt dissolved in the liquid.

GENERAL DESCRIPTION

The apparatus and method of this invention combine a gaseous fluid to be processed with a liquid to form a foam. The foam is then processed, after which the gaseous fluid is separated from the liquid. The further description of the invention is, for clarity, directed to a compression process. However, many aspects and advantages of this application of the invention apply to other uses.

In the compression of a gas foamed with liquid, the liquid rapidly absorbs heat, particularly heat of compression, from the gas due to the high surface-to-volume ratio of the foamed liquid. Further, the high heat capacity of the liquid enables it to absorb a large amount of heat from the gas without a significant temperature increase. These heat transfer mechanisms make it possible to compress the foam as rapidly as in a conventional gas compressor, and still maintain the gas temperature essentially as close to isothermal as desired.

As used herein, the term "foam" means a liquid-gas structure having a thin, continuous distribution of the liquid and containing a discontinuous, i.e. largely closed-cell, distribution of the gas. The invention is practiced with a transient foam, which as used herein means a foam that is stable, i.e. maintains the foregoing structure, throughout a multifold compression. Further, a transient foam is one which separates into separate liquid and gas constituents upon centrifugation, or with other known liquid-gas foam separation processes.

The invention can be practiced with a foaming chamber that combines the liquid and the gas into a foam, a compressor for subjecting the foam to a load and thereby compressing the foamed gas, and a separator that separates the compressed gas from the liquid. A pressure tank stores the compressed gas and either it or a separate tank stores the liquid. Prior to recycling the recovered liquid back to the foaming chamber, it can be cooled to the extent desired. When the liquid is sufficiently cooled, it will condense water vapor out of the gas, as is often desirable, in the foaming chamber. Further, cooling of the liquid to significantly lower the temperature of the gas prior to compression will increase the efficiency of the subsequent compression.

The advantages of gas compression according to the invention fall broadly into two categories, one of which is that the compression can be achieved with lower cost equipment as compared with conventional gas compressors. The other advantages are in increased compression efficiency, i.e. in reducing the input work required for a given measure of compression.

The economies in capital equipment are due to the significantly higher mass density of the foam as compared with a gas by itself. This multifold increase in density enables a rotary compressor of correspondingly smaller size, and hence less cost, to compress the foamed gas than would be required to compress the gas alone.

The compression efficiencies result from other properties of the foam which are absent from the gas by itself. In particular, the liquid foam is essentially a continuous liquid body with separate gas volumes. The foamed liquid has a high surface to volume ratio, and a fine foam is desired to enhance this property. Further, the heat capacity of liquid is many times that of gas. These properties of the foam enable the foamed liquid to absorb heat of compression from the gas essentially instantaneously, and to hold any temperature increase of the gas during compression to a minimal or other desired value. Consequently, the resultant compression can be essentially isothermal, which is known to require less input power to perform than where the gas temperature rises.

In most applications of the invention to a compression process, the recovered foam liquid is cooled prior to recycling it to the foaming chamber.

The relative ease in cooling a liquid rather than a gas, due to the more efficient heat exchange with a liquid, enhances the overall efficiencies of the foam compressor of the invention and reduces the equipment cost.

Considering the practice of the invention further, liquids with which a gas can be foamed for compression preferably have optimized foam strength; relatively high density, heat capacity and boiling point; and relatively low viscosity, volatility and gas solubility. Preferable foam liquids also generally are non-toxic, nonflammable, non-corrosive and have significant lubricating properties. By way of example, suitable liquids include aqueous solutions of metal stearates, metal palmitates, metal laureates, metal oleates, sodium cetyl sulfate, oleic acid, glycerin, saponin, 50% monochlorobenzene — 50% paraffin oil, soaps, a wetting and emulsifying agent such as that available from Rohm & Haas under the tradename Triton X-100, and liquid detergents such as Palmolive brand liquid cleanser. As a further example, the foam liquid can be a solution of triethylene glycol and a surfactant such as N-octadecyl disodium sulfosuccinamate as marketed by American Cyanamid Co. under the name AEROSOL No. 18, a coconut-oil acid ester of sodium isethionate as marketed by Antara Chemicals under the name IGEPON AP-78, or a synthetic detergent consisting of a sulfonated fatty acid amide derivative as marketed by Miranol Chemical Co. under the name MIRANOL.

It is also within the scope of the invention to include a defoaming agent in the foam liquid to facilitate separation of the liquid from the gas. An illustrative defoaming agent for use in a non-aqueous foam liquid is the non-foaming surface-active agent marketed by Air Reduction Co. under the name SURFYNOL 104.

The optimum foam liquid has a heat capacity per unit volume much greater than that of the gas being compressed, does not vaporize in that gas (unless specifically desired), and forms a foam with — and conversely separates from — the gas with minimal energy. Further, that liquid forms a foam with the gas being compressed of such structure and density that the liquid can maintain the gas at the ambient or its other initial temperature during compression, and the density of the foam is sufficient for practical centrifugal compression at relatively low speeds of impeller rotation.

The foam can be produced in any manner desired; among known techniques are forcing the gas through a thin porous material, such as a sheet or net, covered with the liquid; and subjecting the liquid to shear or other agitation in a stream of gas. It is desirable that the foam bubbles not coalesce significantly or take on additional liquid, so that the foam has a fine bubble structure. The velocity of the gas and/or liquid in the foam chamber, whether due to pressure of the incoming liquid, of a feed pump or fan, and/or of aspiration from the compressor, generally is sufficient to remove the just-formed foam from the site of foaming and, correspondingly, from the availability of additional liquid. It thereby facilitates attaining the foregoing end. However, where desired, mechanical means such as an auger wiping the foam from the porous sheet where it is produced, can expedite the foam removal. Similarly, means can be provided to screen the foam or otherwise control bubble size before the foam enters the compressor.

The foam density can be selected to balance factors such as the requirement for larger and more rapidly rotating machinery where a low density foam is used, and the requirement to impart more momentum energy to the foam as its density increases.

The control of foam density, i.e. bubble size and bubble wall thickness, has been found to be important in maintaining optimum and stable operation of a compressor. This is considered to be due to changes in the foam compression with foam density. Thus, a change in foam density is detectable as a change in the load on the compressor and as a change in the compressor discharge pressure. The desired control of foam density can be done during formation of the foam, as by adjusting pressures and flow rates of the gas and/or the liquid. The control of gas and/or liquid flow and/or pressure in the foaming chamber suitably is done in response to changes in compressor load or discharge pressure, using conventional techniques. Bubble size in the foam can, where desired, be controlled prior to compression, as by passing the foam through a sizing screen. Provision also can be made to remove drops of the foam liquid from the foam prior to compression.

In an open gas system, i.e. where the gas (e.g. air) is not recycled, dirt and vapors in the gas can be removed with filters and absorbers to preserve the foaming properties of the liquid. The foam liquid also can be cleansed of dirt, condensed vapors and other contaminants by other conventional treatments.

The compressor of the foam can be of many types, the principal ones being rotary and reciprocating. The foam flow rate through the compressor is such as to provide sufficient time for compression of the gas, and for heat transfer from the gas to the liquid. Since the foam bubbles decrease in size and increase in wall thickness with pressure, the gas-liquid heat transfer rate increases with compression. By way of a typical example, aa centrifugal compressor working with a foam of 0.625 lb./cu. ft. initial density with atmospheric pressure gas gives an isothermal pressure of ten atmospheres with an impeller tip speed of 450 ft./sec.

Where the compressor is of a type, e.g. centrifugal, that imparts velocity to the foam, a diffuser preferably is provided to receive the compressed foam. The diffuser recovers a portion of the velocity energy by converting it to static pressure, and thereby increases the gas compression. The construction of diffusers for this purpose is well known.

The liquid and gas of the compressed foam can be separated readily, as by centrifugation, due to their disparate densities. A rotary compressor accordingly is generally desired, for it can impart sufficient velocity to the foam to create a centrifugal force to separate the liquid from the gas. That is, the compressed foam enters a defoaming chamber with centrifugal force that stratifies defoamed gas, foam, and foam liquid. Alternative or supplementary to defoaming by centrifugation, other mechanisms including ultrasonic decavitation, gravity separation, straining, impingement on a moving surface, and temperature cycling, can be employed. Whatever means of separation are employed, it maintains the liquid and the gas under substantially the same pressure as the compressor imparted to the foam.

The liquid is recovered by diverting it from the defoaming chamber, generally through a liquid diffuser to increase its pressure. To retain foam in the chamber, the diversion means is sensitive to the presence of defoamed liquid in the defoamer. The recovered liquid can be passed through a heat exchanger to release the heat of compression it absorbed and, where desired, to cool it further, e.g. below ambient. The exchanger can be of the more efficient liquid-liquid type rather than a gas-liquid unit or gas-gas unit as would be required to cool the compressed gas directly. Further, where the gas needs to be dried, the foam liquid can be cooled at this point to such a degree that the moisture precipitates upon contact with the cooled liquid in the foaming chamber. Alternatively, the foam liquid can include dessicants to remove moisture from the gas.

The separated compressed gas and foam liquid, which is also under pressure, can be stored in separate pressure vessels, or in a common receiver. The liquid reservoir can function as a heat sink for the liquid. Check valves can be provided as needed to prevent reverse flow of either fluid, and care should be taken in handling the liquid to avoid agitation that will produce foaming.

The compressed gas is available for use from the receiver.

The liquid, on the other hand, is recycled through the compressor. The pressure of the liquid can be utilized, with additional pumping where needed, to drive the liquid through the foaming chamber. Also controls on liquid pressure and flow can be imposed at this point to regulate foam density, as noted above.

The practice of the invention in gas compression is thus seen to employ the steps of foaming a gas to be compressed with a liquid and subjecting the foam to a load to compress the gas. The foaming step includes control and regulation to generate the foam with uniform density and a generally fine bubble structure. Where the compression step accelerates the foam so that it has a residual velocity, e.g. where the compression involves rotary motion, it is generally desirable to recover at least a portion of the velocity by decelerating the compressed foam as in a diffuser and thereby converting a portion of its velocity to additional static pressure.

The compressed foam is separated into its liquid and gas constituents, each of which can, where appropriate, be subjected to further deceleration in separate stages.

The compressed gas is then fed, typically through a check valve, to a pressure tank or other receiver, from which it is utilized.

The separated foam liquid is stored, and generally cooled to remove at least the heat of compression which it absorbed. The liquid is preferably maintained under the pressure it has after separation and after whatever diffusion to which it is subjected. It can be stored separate from the compressed gas or in the same vessel. In recycling the liquid, i.e. again foaming it with gas, the feed of the liquid is controlled and regulated to regulate and control the structure of the resultant foam.

Additional steps which the practice of the invention can employ are to cleanse the gas of dirt, vapors or other contaminants prior to the foaming step. Similarly, the foam liquid can be cleansed of solids and of fluid vapors and replenished, as necessary to maintain its performance over an extended period.

The invention also can be practiced with a refrigerant that is a vapor prior to compression and during foaming, and which liquifies upon loading of the foam. In this application of the invention, the separation operation separates the refrigerant liquid from the foam liquid.

The application of liquid foam to thermodynamic processes which this invention provides yields multiple advantages. As already discussed, utilization of the invention in a gas compressor results in a reduction in equipment cost and a reduction in operating cost, as contrasted with a conventional gas compressor.

Another use of the invention is in a system storing energy in the form of gas which has been compressed in a foam and then separated from the foam liquid. The essentially isothermal compression of the foamed gas yields high compression efficiency, and the attainment of compressed gas at the environmental temperature makes it possible to transport and to store the gas with minimal energy loss. Hence, such a storage system is economically practical for using off-peak energy to compress the gas for storage, and subsequent utilization of the compressed gas during peak power consumption. The stored energy can be used in any one of a number of power generating systems, including the generation of electrical power as well as in a refrigeration system having periods of peak consumption.

The foregoing advantages, features and applications of the invention to a compression process apply in large part to expansion of a gaseous fluid. That is, a compressed gaseous fluid can be combined with a foam liquid in a transient foam, and the foam expanded essentially isothermally in an expansion engine, after which the foamed materials can be separated.

It should also be appreciated that a gas foamed with a liquid in accordance with the invention can be heated or cooled efficiently and with compact equipment. In other words, the heat transfer with a gas is greatly enhanced when the gas is in a liquid foam in accordance with the invention.

In addition to the manifold increases in heat transfer rate with a gas when in a liquid foam in accordance with the invention, a gas can be further modified when in the liquid foam stage. Further modification can include drying, the addition of vapor to the gas, and subjecting the gas to chemical reactions.

The invention accordingly comprises the several steps and the relation of one or more of such steps with respect to each of the others, and the apparatus embodying features of construction, combinations of elements and arrangements of parts adapted to effect such steps, all as set forth above and as further exemplified in the following detailed disclosure, and the scope of the invention is indicated in the claims.

For a further understanding of the nature and objects of the invention, reference should be made to the following description of preferred illustrative embodiments and the accompanying drawings, in which FIG. 1 is a side elevation view, partly broken away and partly in section, of a gas compressor system embodying features of the invention;

DESCRIPTION OF ILLUSTRATED EMBODIMENTS

Figure 1:
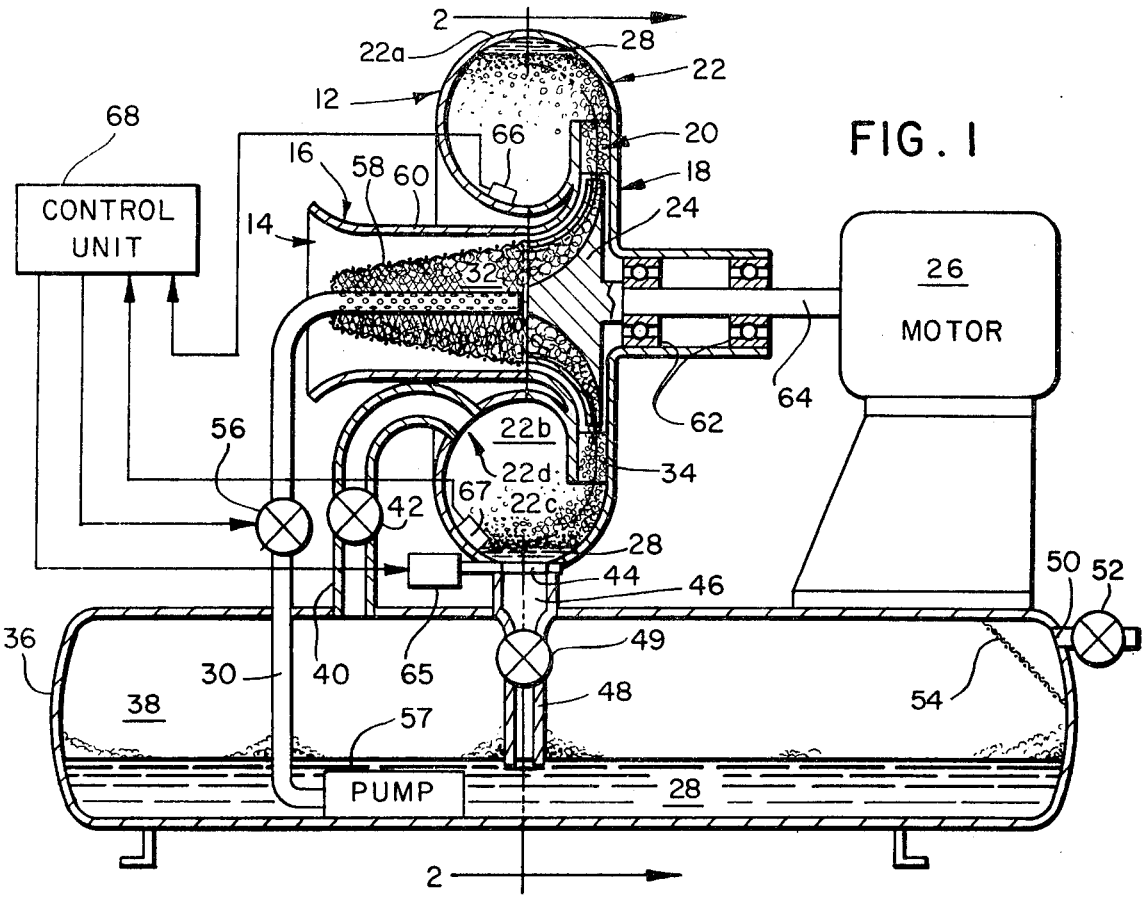
Figure 2:
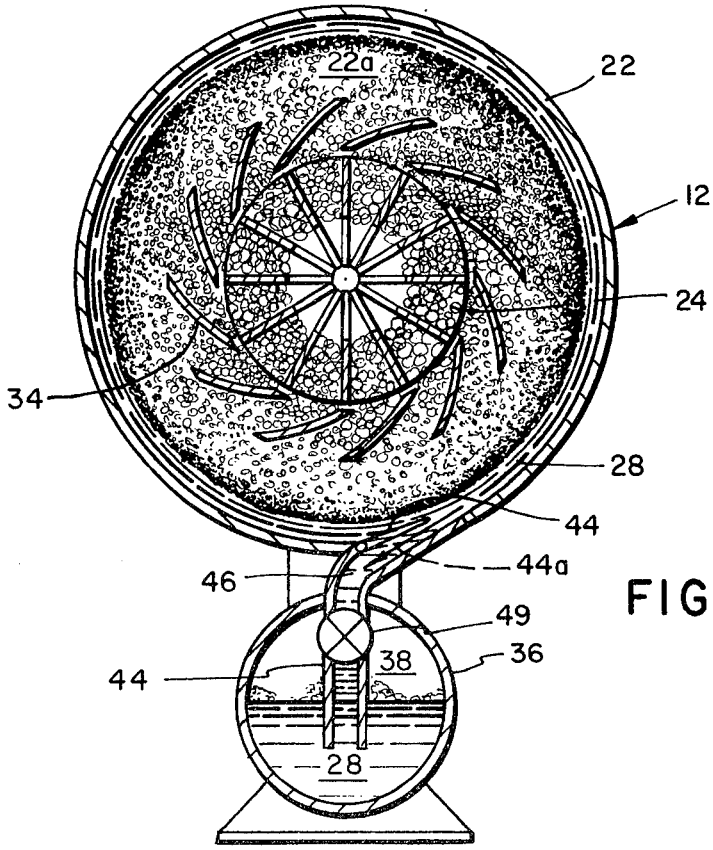
FIG. 2 is a sectional view of the compression system of FIG. 1 taken along section line 2—2 therein.

FIGS. 1 and 2 show an air compressor system of the rotary type embodying the invention. The compressor housing 12 forms an air inlet port 14, a foaming chamber 16, an impeller chamber 18, a foam diffuser 20, and a separation chamber 22. An impeller 24, in the impeller chamber 18, is mounted to the housing 12 for rotation relative thereto by an electric motor 26 and draws air into the port 14. In the foaming chamber 16, the air is foamed with a liquid 28, which a feed pipe 30 delivers to the chamber. The impeller subjects the foam 32 to a load, compressing the gas therein, and delivers the compressed foam to a diffuser 20 which is illustrated as including stationary vanes 34. The foam exits from the diffuser 20 to the separation chamber 22 with a centrifugal velocity which impells the foam liquid against the radially outer, peripheral, portion **22*a*** of the separation chamber, thereby separating the liquid from the gas.

The compressor system is illustrated as having a pressure tank 36 which serves as a reservoir for both compressed air 38 and for the foam liquid 28. The tank receives compressed air from the separation chamber 22 of the compressor by way of a duct 40 having a check valve 42 therein and exiting from the separation chamber at a radially inner location **22*b*. Compressed air is drawn from the compressor tank 36 in any conventional manner as FIG. 1 illustrates with an outlet port 50 fitted with a control valve 52. The tank is further illustrated as having a screen 54** that blocks liquid and foam from entering the outlet port; the screen is illustrative of any known baffle means providing this function.

A liquid scoop 44 located in the bottom of the separation chamber portion **22*b* diverts liquid 28 from the chamber 22 to a diffuser 46, which feeds the liquid to the tank 38 by way of a pipe 48 fitted with a check valve 49**.

With further reference to FIGS. 1 and 2, the liquid feed pipe 30 feeds foam liquid 28 from the pressure tank 36, where it is under pressure, through a liquid control valve 56 to the foaming chamber 16. There, as stated above, it is foamed with air.

The compressor system can also include a pump 57 for pumping liquid into the foaming chamber 16, via feed pipe 30, during start-up when there is insufficient pressure in the tank 36 to force the requisite liquid into the chamber 16. The illustrated motor-driven pump is located in the tank 36 and includes a pressure sensor for operation in response to the gas pressure. Alternative to operating the pump only during start-up or other times of low pressure, it can be operated continuously. The power which the pump consumes will yield an offsetting saving in power to operate the compressor.

The foregoing compression of gas while it is foamed with a liquid provides a uniquely new and efficient heat transfer mechanism for removing the heat of compression from the gas. Specifically, the foam provides a multifold increase in the ratio of gas surface which is exposed to the heat exchange medium, here the foam liquid, to the gas volume. Further, the foam liquid has many times the heat capacity of the gas. The attainment of these factors makes possible an extremely rapid transfer of heat of compression from the gas to the liquid, and with minimal increase in the temperature of the liquid. Hence, the temperature of the gas remains essentially throughout the compression process, so that the resultant compressed gas has very nearly the same temperature as the uncompressed gas.

A further advantage of the invention is that the liquid foam is many times denser than the gas being compressed, and hence can be pumped or otherwise moved with rotating machinery that is smaller, and operates at a slower speed, by a corresponding degree than required for handling gases along.

With further reference to FIGS. 1 and 2, the illustrated foam chamber 16 is generally of tubular shape with a circular cross section, i.e. a surface of revolution and with the air inlet port 14 at one axial end thereof. The chamber is concentric with the axis of rotation of the impeller 24. The illustrated chamber houses a conical foaming screen 58 coaxially disposed therein with the apex pointed toward and proximal to the inlet port 14 and the large end (the right end in FIG. 1) joining the chamber 16 wall at the end of the chamber proximal to the impeller chamber 18. The liquid feed pipe 30 enters the foaming chamber 16 through the inlet port and passes through the foaming screen 58 to extend within the screen, as illustrated. The section **30*a* of feed pipe 30 within the foaming screen 58** is apertured to spray the liquid radially outwardly onto the screen, so as to coat the screen with liquid continually during operation of the compressor system.

As the air passes through the sheet of liquid on the screen, it picks up the liquid, thereby producing the desired foam. This manner of producing a liquid foam for practicing the invention is illustrative of one of numerous known techniques, and it and other techniques known in the art can be practiced with conventional skills.

The illustrated housing wall 60 which forms the foam chamber 16 also forms, with a smooth outwardly-flaring transition, the outer wall of the impeller chamber 18, which is also of circular cross-section in the plane of FIG. 2 and concentric with the foaming chamber 16. This construction of an impeller chamber, and that of the impeller 24 therein, are conventional for the particular foam density and compression ratio desired. The compressor housing 12, as FIG. 1 shows, also mounts bearings 62, 62 in which the motor-impeller shaft 64 is journaled.

The foam diffuser 20 can be of conventional construction corresponding with the impeller design for converting the portion of the velocity which the impeller imparts to the foam to pressure, thereby increasing the gas compression. The diffuser vanes 34 diminish the discontinuity in foam flow between the impeller and the separation chamber and impart a circumferential velocity to the foam. For this reason, the vanes can have a spiral-like configuration as shown in FIG. 2.

The illustrated separation chamber 22 is of generally toroidal shape, and houses the foam diffuser 20 along one axial side and inwardly from the radially outermost wall portion **22*a*. The radial dimension of the chamber provides sufficient space for the centrifugal separation of foam liquid from foam and from the compressed gas in correspondence with the radial velocity with which the foam enters the chamber. The axial dimension of the separation chamber is selected in correspondence with the radial dimension to provide the desired chamber volume. The chamber 22 is closed except for the entry thereinto from the compressor, via the diffuser, and except for the liquid outlet port 22*c* to the diffuser 46 and to conduit 48, and for the gas outlet port 22*d*. The latter port, i.e. the exit of the conduit 40** from the chamber 22, is desirably axial spaced and/or baffled from the diffuser to minimize the entrance of foam into the conduit 40 and hence into the pressure tank 36.

As discussed above, compressed foam enters the separation chamber from the compressor impeller 24 via the diffuser 34. The heavier liquid constituent is impelled against the outer wall of the chamber, as FIGS. 1 and 2 show with the "belt" of liquid 28 in the separation chamber outer portion 22*a*. The separated liquid exits from the separation chamber 22 to the conduit 48 by way of the liquid port 22*c*, under control by the liquid scoop 44. The liquid scoop 44 is illustrated simply as a plate hinged to the wall of chamber 22 at the outermost and lowermost portion of the chamber, which is the location where most foam liquid collects, due to the combined effects of centrifugation of the foam and gravity. A scoop control activator 65 moves the scoop 44 plate between a closed position (indicated in FIG. 2 with dashed line 44*a*) where it seals the liquid port 22*c* closed, and an open position, as shown.

The separation chamber 22 also is fitted with a pressure sensor 66, generally in the radially inner portion 22*b* as illustrated, to sense the gas pressure in the chamber 22. When the compressor system is operating, the sensor 66 thus senses the pressure to which gas is being compressed. Another sensor 67 in the chamber 22 responds to liquid separated from foam therein for controlling the scoop 44. To this end, the sensor 67 is located in the chamber portion 22*a* at a selected radial distance inward from the radially outermost location, for exposure to separated liquid in excess of a selected minimum volume. When the volume of separated liquid exceeds this amount, the sensor is subjected to the pressure of the liquid. Alternative to responding to liquid pressure, the sensor 67 can respond to the depth of liquid in the chamber portion 22*a*. This arrangement of sensor 67 is desired because a minimum level of separated liquid is needed in the chamber 22 during operation to provide, with scoop 44, a pressure seal or barrier across the liquid exit port 22*c*, and thereby maintain compression pressure in the chamber. Separated liquid in excess of this pressure-sealing amount, however, is to be removed via scoop 44 and the signal from sensor 67 is used to control this operation.

The signals from sensors 66 and 67 are applied to a control unit 68, which responds to the signals to regulate the scoop 44 by way of activator 65 and to regulate control valve 56. That is, the control unit maintains the scoop 44 closed until the minimal level of liquid is present in the separation chamber, and controls the amount of scoop opening to divert separated liquid from the chamber so long as the chamber pressure maintains the desired minimum level. The control unit controls the valve 56 to control the feed of liquid to the foaming chamber. As discussed above, this controls and regulates the foam being produced. The sensors 66 and 67, as well as the control unit 68 and the scoop activator 65 employ conventional constructions known to those skilled in fluid-control practices.

Figure 3:
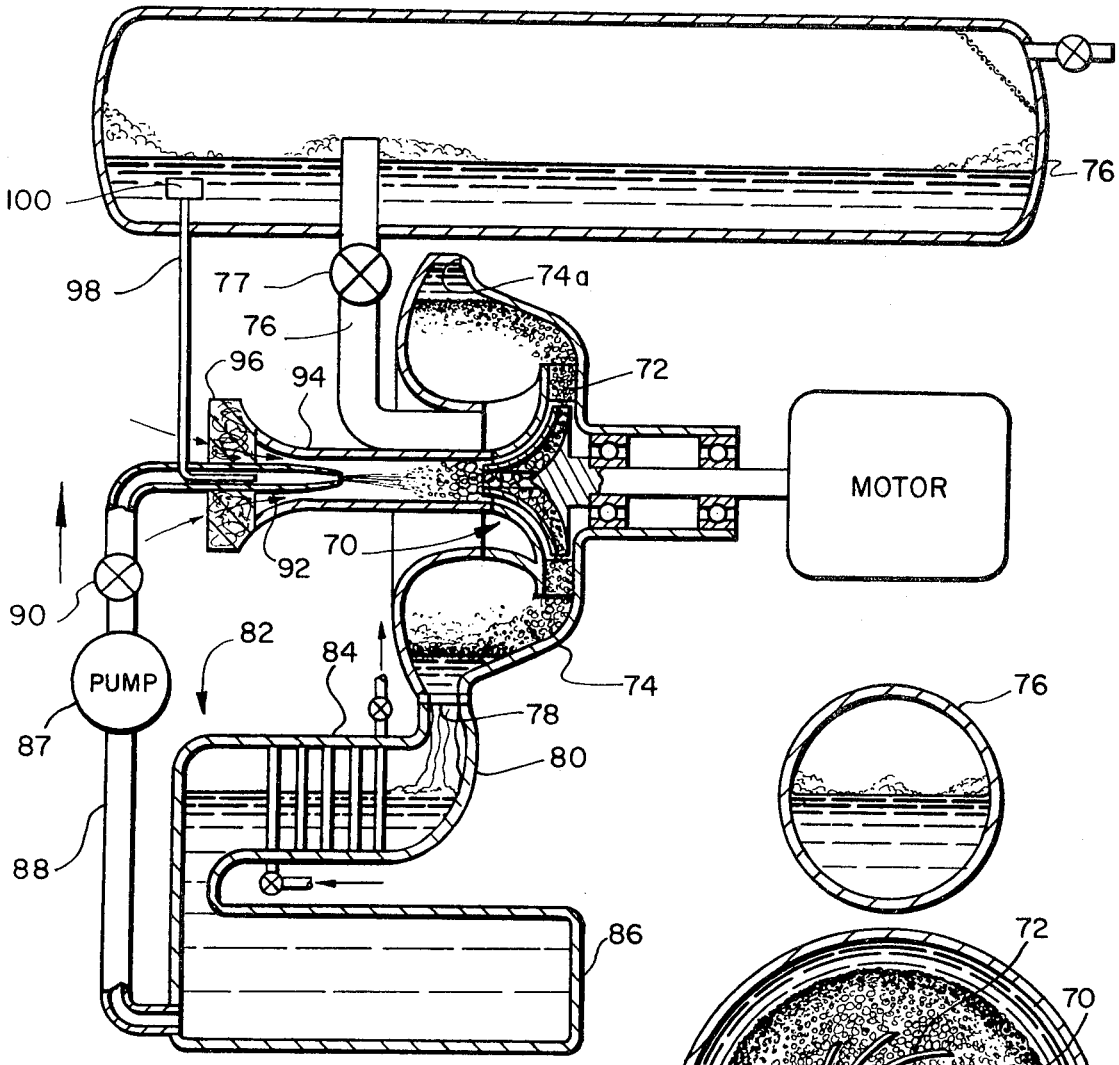
FIGS. 3 and 4 are side and end elevation views, respectively, partly broken away and partly in section, of another gas compression system embodying features of the invention.
Figure 4:
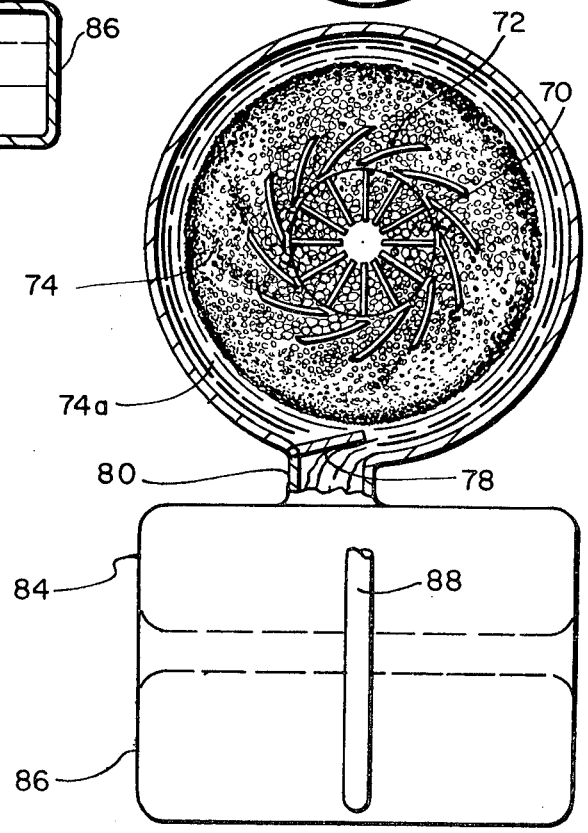

The separation of liquid from compressed foam by centrifugation, as the compressor system of FIGS. 1 and 2 performs, requires considerable kinetic energy, most of which is in the liquid. The passage of the separated liquid through a diffuser, such as the liquid diffuser 46, recovers some of this energy to increase the pressure of the liquid. FIGS. 3 and 4 illustrate a compressor system that recovers more of this kinetic energy to realize additional operating efficiencies.

More particularly, the compressor system of FIGS. 3 and 4 stores recovered foam liquid in a separate reservoir under the pressure resulting from the centrifugal separation. The pressure energy is utilized to force the liquid through an aspirator nozzle to foam it with the gas, and to drive the foam into the intake of the compressor. The net effect is to utilize the pressure of the liquid after defoaming to reduce the input energy which the system requires to form the foam and to operate the foam compressor.

With specific regard to the compressor system of FIGS. 3 and 4, it has a motor-driven axial impeller 70 subjecting foam to a load, thereby compressing the gas therein, and delivering the compressed foam through a diffuser 72 to a separator 74, all in a manner similar to that described above with reference to FIGS. 1 and 2. A conduit 76 leading from the radially inner portion of the separator 74 delivers the compressed gas recovered in the separator to a pressure tank 76, preferably through a check valve 77. The illustrated separator 74 has a radially outermost annular trough 74*a* which collects the centrifugally-separated liquid. A liquid scoop 78 diverts liquid, in excess of that required to seal gas from the liquid exit, from the separator trough to a pressured liquid recycle unit 82.

The unit 82 receives the pressured liquid through a diffuser 80, and delivers it to a heat exchanger 84. The heat exchanger 84 removes heat which the liquid absorbed from the foamed gas during compression, and can further reduce the liquid temperature as desired. The liquid recycle unit 82 also includes a reservoir 86 that stores the pressured liquid, either after cooling as illustrated or prior thereto whichever is desired, although the illustrated arrangement is considered preferable. A pump 87 is coupled with the reservoir 86, or elsewhere in the unit 82, to provide pressure for the liquid during start-up and in the event of a pressure drop during operation.

A feed line 88 feeds the cool pressured liquid through a liquid control valve 90 to a nozzle aspirator 92 located within a foaming chamber 94. The foam chamber 94 receives air at its inlet port through an optional gas cleaner 96 and guides the air into the liquid spray from the nozzle 92 for foaming the liquid with the gas. As in FIG. 1, the compressor 70 receives the foam directly from the chamber 94. However, in the compressor system of FIGS. 3 and 4, the pressure energy of the liquid drives the foam into the intake of the compressor with significant velocity, which reduces the motor power required to drive the compressor. This illustrates that the invention can be practiced with a compressor system in which compression of the foam results solely from the velocity of the liquid, i.e. in which pump means such as pump 87 of FIG. 3 provides all the input power to effect the foam compression.

The compressor system of FIGS. 3 and 4 also has provision for recycling foam liquid which passes into the pressure tank with the compressed gas. As indicated, any liquid which collects in the pressure tank 76 drains through a pipe 98 into the aspirator nozzle 92. It should be noted that under most conditions of operation, the liquid in the pressure recycling unit 82 will be at a greater pressure than the compressed gas within the tank 76. A liquid level control 100 in the liquid well within the pressure tank 76 is operated, as by a control unit such as the unit 68 of FIG. 1, in conjunction with the liquid valve 90 to draw liquid from the tank into the aspirator nozzle at a rate to maintain the desired maximum liquid level within the tank, and to attain the desired foam composition.

Figure 5:
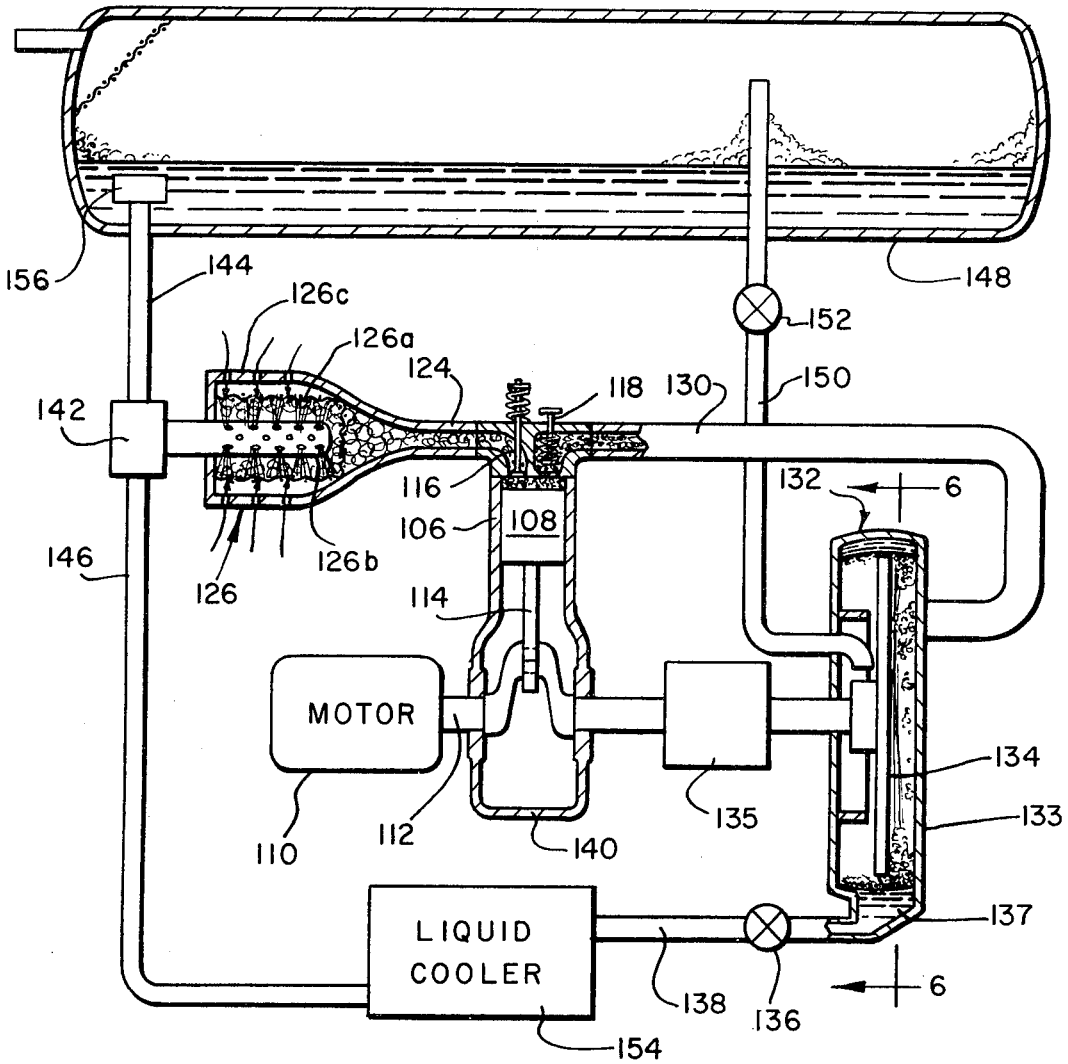
FIGS. 5 and 6 are, respectively, a side elevation view partly in section and partly broken away, and a sectional view along line 6—6, of a gas compression system in accordance with the invention and having a reciprocating compressor.
Figure 6:
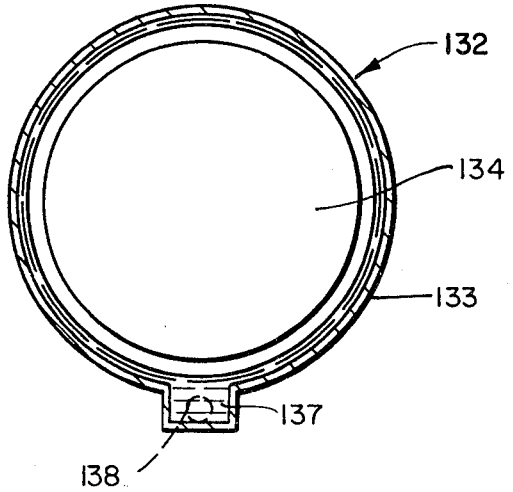

FIGS. 5 and 6 illustrate the practice of the invention with a reciprocating compressor illustrated as having a cylinder 106 fitted with a piston 108. An electric motor 110 drives the piston by way of a crankshaft 112 and a connecting rod 114, and the head of the cylinder is fitted with an intake valve 116, and an exhaust valve 118, both of which are illustrated as automatic, i.e. operate in response to cylinder pressure.

An intake conduit 124 feeds liquid foam from a foam chamber 126 to the compressor cylinder 106 by way of the intake valve 116. The exhaust valve 118 controls the delivery of compressed foam from the cylinder 106 to an exhaust conduit 130 that leads to a separator 132. A compressor casing 140 forms the intake and exhaust conduits, the cylinder walls and the supporting structure for the crankshaft 112.

The illustrated separator 132 has a stationary cylinder housing 133 within which a defoaming disk 134 is mounted for rotation by the compressor crankshaft through a gearbox 135. The powered disk is provided because the compressed foam may lack sufficient kinetic energy for efficient centrifugation. The exhaust conduit 130 directs compressed foam onto the driven disk but off center, as indicated. The impingement of the foam onto the rotating disk surface breaks down the foam structure. Compressed gas essentially free of foam liquid is withdrawn from the housing near the center of disk rotation by way of a conduit 150. The separated liquid drains out at a bottom port 137, illustratively through a valve 136. The valve, illustrated in lieu of a scoop as in the previously-described compressor systems, can be automatic to pass liquid only when there is sufficient liquid in the housing to block gas and foam from the port 137. Alternatively, it can be controlled in response to a sensor of the liquid pressure within the separator housing, as discussed with reference to FIGS. 1 and 2. The return passage 138 leading from valve 136 can include a liquid diffuser, as previously discussed.

The operation of the reciprocating compressor system is basically the same as that for the rotary systems. The downward, expansion stroke of piston 108 draws air into the foaming chamber 126 where it foams with liquid fed to the chamber by way of a control valve 142 which receives liquid from a feed pipe 144 and a recirculating pipe 146. The foam is drawn into the cylinder by way of the intake conduit 124 and the open intake valve 116; the exhaust valve is closed at this point.

As the piston commences its upward, compressor stroke, the intake valve 116 closes and the exhaust 118 remains closed, with the result that the piston compresses the foam within the cylinder. Near the peak of the compression stroke, the exhaust valve 118 opens, and the compressed foam exits the cylinder by way of conduit 130 and enters the separator 132. Pressure conduit 150 feeds the compressed gas from the separator to a pressure tank 148, typically through a check valve 152.

The separated liquid is fed from the separator, as described previously, to a cooler 154 and then back to the foam chamber by way of the recirculating pipe 146. Liquid which is carried into the pressure tank with the compressed gas is fed back to the control valve 142 by the feed pipe 144 under control of a level control valve 156. The system can also include means for pumping liquid to the foam chamber 126 during start-up conditions.

By way of further illustration, the foaming chamber 126 shown in FIG. 5 has a cylindrical porous membrane **126*a* onto which a coaxial inner spray tube 126*b* deposits the foam liquid. Air enters the chamber through a cylindrical filter 126*c* coaxially outside the membrane, and is drawn into the intake conduit 124** through the membrane, where it foams the liquid.

Figure 7:
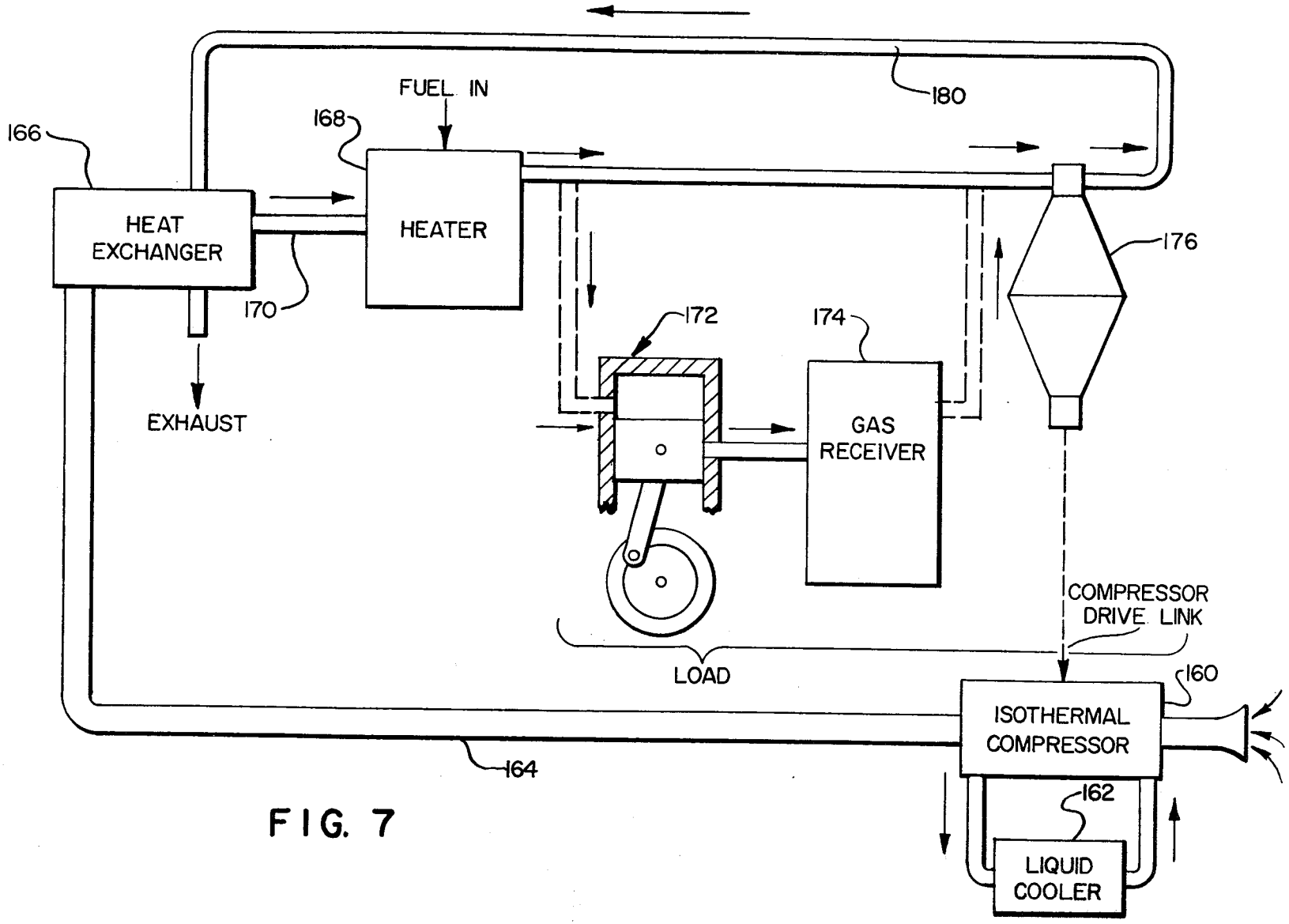
FIG. 7 is a schematic block diagram of a power system embodying features of the invention.

FIG. 7 illustrates, in schematic form, a power system that realizes significant economies by utilizing the essentially isothermal compression which the invention makes possible. The power system has an isothermal air compressor 160 constructed in accordance with the foregoing teachings regarding FIGS. 1 through 6 with a cooler 162 for the foam liquid. A conduit 164 feeds the compressed gas from the compressor to a counterflow heat exchanger 166, and the resultant heated compressed gas is fed to a heater 168 by way of a passage 170. The heater, typically of the fuel injector type, receives fuel or heat energy from an external source, as indicated, for heating the gas still further.

From the heater 168, the hot compressed working fluid, i.e. the gas, is fed to load for extracting work from it. This is illustrated in FIG. 7 by applying the compressed gas to drive a turbine 176. The rotary power outut from the turbine can, at least in part, drive the compressor 160, as indicated.

Alternative to applying the compressed gas to the heater 168, from the counterflow heat exchanger 166 it can be applied, as FIG. 7 also indicates, to an internal combustion engine 172, which produces output torque at its flywheel. The engine 172 can include intake and outlet valves for timing the emission of the compressed gas to the cylinder, and the exhaust, with the piston travel as conventional; and can be multi-cylinder. The partially-cooled and partially-expanded gas output from the engine is then delivered to a gas receiver (pressue tank) 174 and thence drives the turbine 176.

With whatever load configuration is used, a conduit 180 recycles the spent working fluid from the turbine to the heat exchanger 166, where it imparts the remaining heat therein to the cool compressed working fluid received from the compressor. The essentially isothermal compression of the fresh working fluid (air or other gas) in compressor 160, which maintains it at essentially ambient temperature, enables it to recover an unusually large percentage of heat energy in the counterflow heat exchanger. Consequently, the spent working fluid finally exhausted from the system, at the heat exchanger exhaust, can be close to ambient temperature and, in a open system, be at essentially atmospheric pressure.

Figure 8:
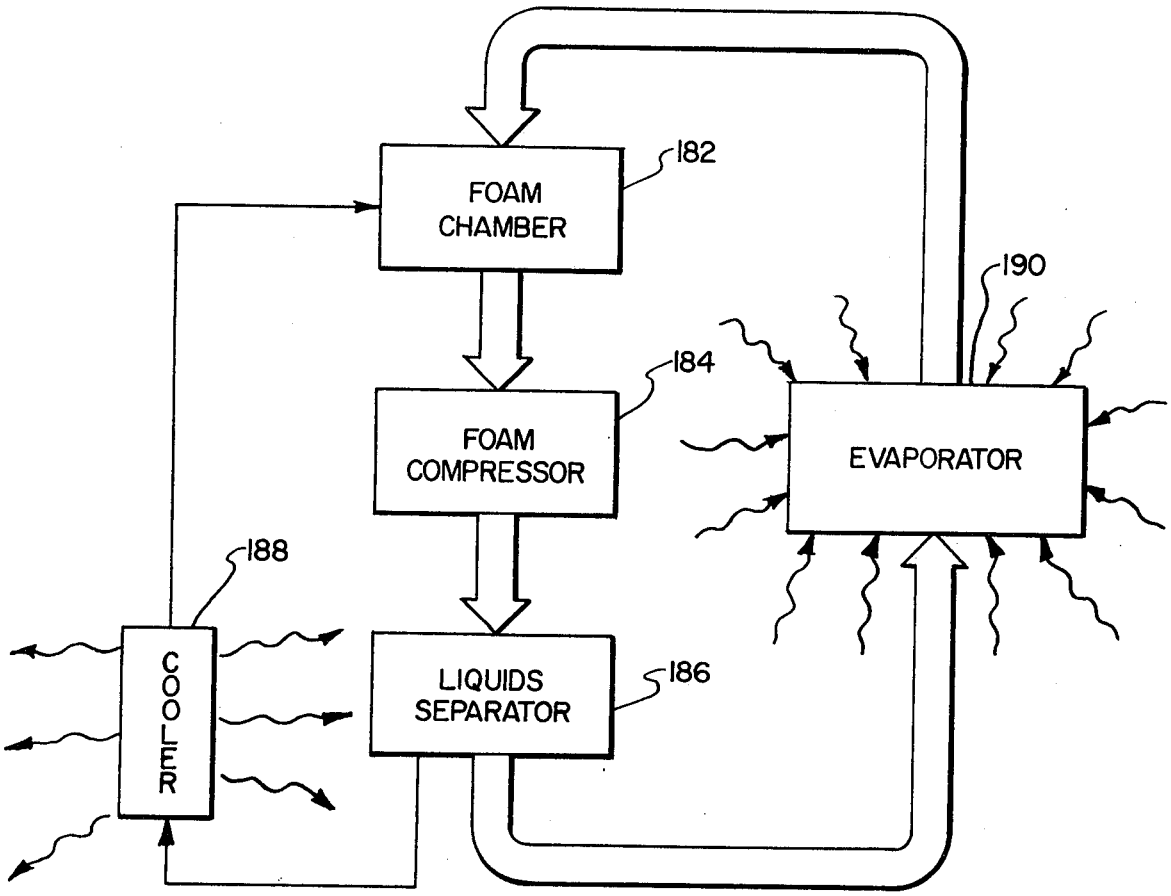
FIG. 8 is a schematic block diagram of a refrigeration system embodying features of the invention.

FIG. 8 illustrates the application of the invention to a refrigerant compressor, and further illustrates the application of the invention to compression of a vapor and to a system having a closed path for the working fluid. The illustrated refrigerator has a foam chamber 182 where liquid is foamed with a refrigerant, e.g. freon, in the vapor state. A foam compressor 184 subjects the foam to a compressive load, thereby compressing the vapor constituent. The compression, which is essentially isothermal as described hereinabove, liquifies the refrigerant vapor so that the foam becomes a mixture of two liquids, i.e. the foam liquid and the liquid refrigerant.

A liquid separator 186 receives the two liquids, which are under pressure, and separates them, typically by means of decantation although other conventional liquid separating techniques can be employed. The requirement that the working fluid, i.e. refrigerant, be separated from the foam liquid while the former is in the liquid state requires that the foam liquid and the liquid working fluid be non-miscible and not dissolve in each other. A cooler 188 receives the separated foam liquid and cools it to remove the heat developed during compression, and returns the cooled liquid to the foam chamber 182, as indicated.

The liquified refrigerant is conducted from the separator 186 to an evaporator 190, constructed in the conventional manner for the refrigeration desired. There it is allowed to expand and vaporize, in the process of which it absorbs heat from medium being refrigerated. The refrigerant vapor then flows, still due to the pressure developed by the foam compressor 184, back to the foam chamber 182, and the cycle repeats.

The foregoing embodiment of the invention for refrigeration demonstrates how the term "gaseous fluid" as used herein includes vapors such as a refrigerant vapor.

One advantage which the present invention brings to a refrigeration cycle as in FIG. 8 is that the essentially isothermal compression eliminates the apparatus conventionally required to remove heat from a refrigerant after non-isothermal compression. Conventional systems require such cooling to bring the refrigerant back to the temperature desired for expansion. Also, condensation of the refrigerant in the isothermal compressor eliminates the conventional separate condensor.

Figure 9:
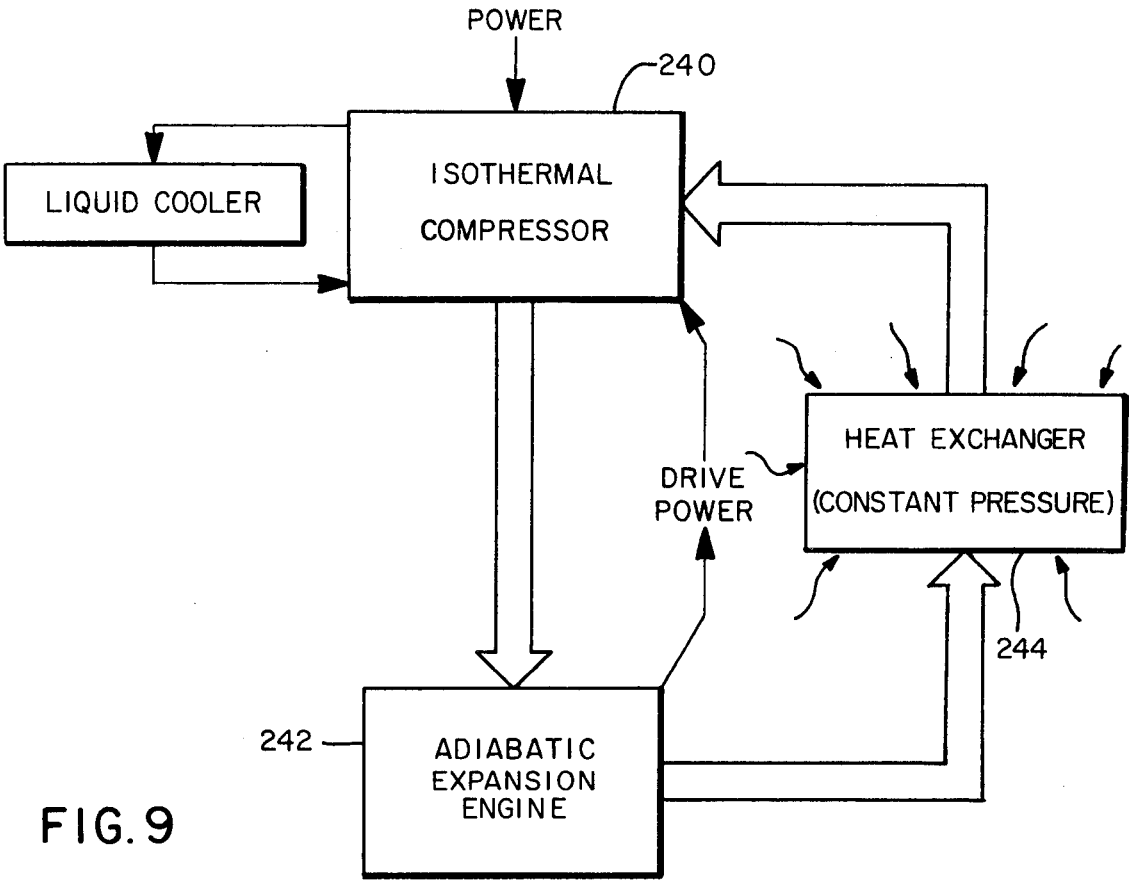
FIG. 9 is a schematic block diagram of another refrigeration system according to the invention.

FIG. 9 illustrates a three-cycle refrigeration system employing the invention and having, in idealized terms, an isothermal refrigerant compressor 240, and adiabatic expansion engine 242, and a constant pressure heat exchanger 244. The compressor foams working fluid, i.e. refrigerant, received from the heat exchanger, compresses it under essentially isothermal conditions, and separates it from the foam liquid, which is cooled as indicated.

Figure 10:
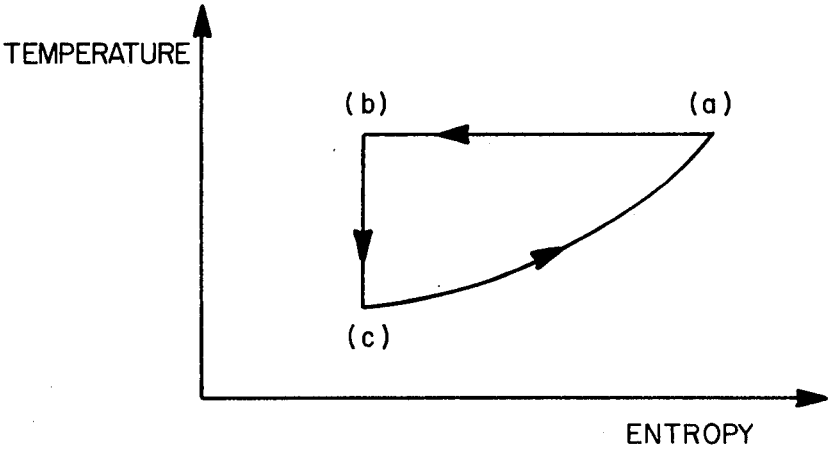
FIG. 10 is a temperature-entropy diagram of the idealized operation of the system of FIG. 9.

FIG. 10, a temperature-entropy diagram illustrating the idealized operation of the FIG. 9 system, depicts the isothermal compression as moving the refrigerant through the cycle step from (*a*) to (*b*).

The adiabatic engine 242 extracts work, which can be applied to the compressor, from the compressed refrigerant by allowing it to expand adiabatically. This expansion cools the refrigerant under essentially isentropic conditions, as FIG. 10 indicates with the corresponding cycle step from (*b*) to (*c*). The heat exchanger 244, which can be of the counterflow or other types which maintain the refrigerant at constant pressure, exposes the cooled and expanded refrigerant from the engine to a heat source or hot fluid which is to be cooled. Consequently, in passing through the heat exchanger, the refrigerant absorbs heat at constant pressure, as FIG. 10 indicates with the corresponding cycle step from (*c*) to (*a*).

The foregoing tricycle refrigeration system thus employs isothermal compression to drive an expansion engine, which in turn cools the working fluid so that it can do further work by absorbing heat.

Figure 11:
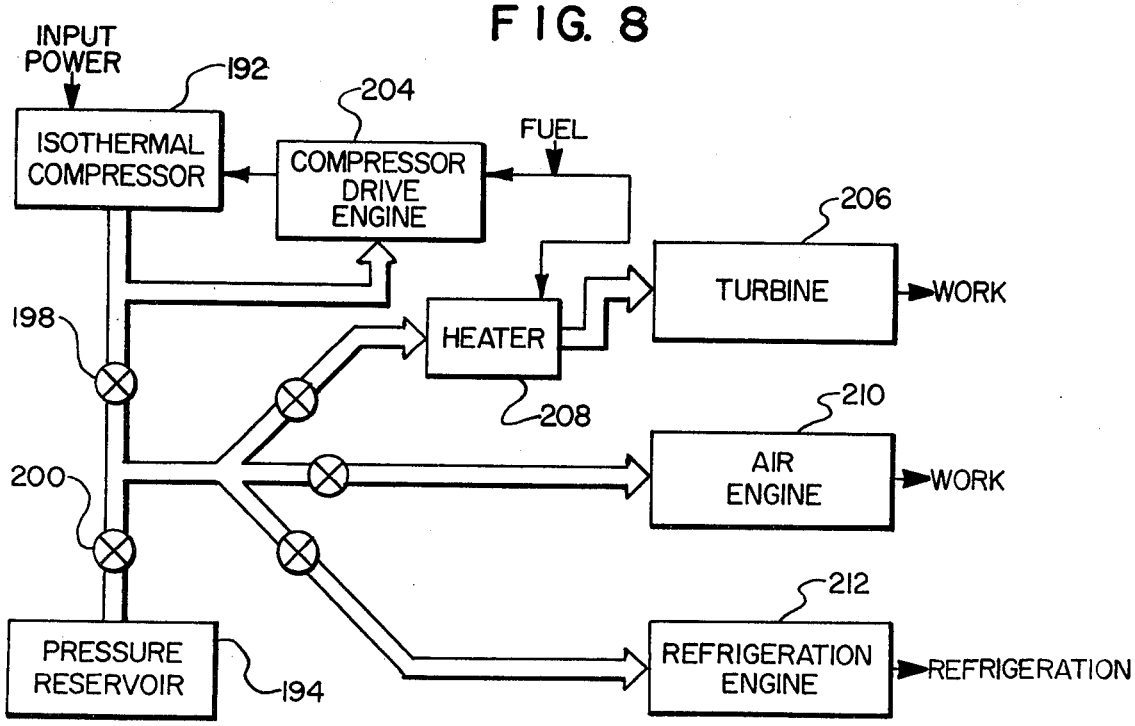
FIG. 11 is a block schematic representation of an energy storage power system embodying features of the invention.

FIG. 11 illustrates a storage-type power system which the realization of essentially isothermal compression with this invention can make feasible. With essentially isothermal compression, a compressed gas is produced at essentially ambient temperature. The gas hence contains little energy in the form of heat, but rather contains energy principally in the form of compression, which is recoverable. Further, the isothermally compressed gas, being at ambient temperature, can be transported and stored without concern for significant heat loss.

The power system of FIG. 11 has an isothermal compressor 192, with a cooler of the foam liquid, as described hereinabove. The compressed working fluid can be fed to either or both a pressure reservoir 194, or to a load indicated generally at 196, by way of controlling valves 198 and 200. Valve 200 also allows compressed gas in the reservoir 194 to drive the load 196. A compressor drive engine 204 also receives working fluid from compressor 192 and uses it, and external fuel, to drive the compressor.

The pressure reservoir 194 is a compressed gas storage vessel of whatever size needed to provide the desired storage. For large scale power systems it is contemplated that the pressure reservoir, for example, by a geological formation, i.e. underground cave, of massive dimensions.

The illustrated load 196 includes a turbine 206 driven by the compressed working fluid after heating in a fueled heater 208. It also includes, for purposes of example, a compressed air engine 210. The engine 210 can be of conventional construction, or, to avoid loss of energy by a temperature drop upon expansion, can subject the compressed working fluid to isothermal expansion after foaming with a liquid, in further accord with the invention. A third element of the illustrated load 196 is a refrigeration engine 212, e.g. an evaporator or other refrigerating heat exchanger, which the compressed working fluid drives.

The power system of FIG. 11 finds application where a load is subject to sharp peaks in power consumption. Rather than provide costly equipment of sufficient capacity to power the peak load at all times, it is desirble to store power to meet the peak demand. With the realization of essentially isothermal compression, the desired energy storage can be in the form of a compressed working fluid. The isothermal compressor 192 and its associated drive apparatus can have less capacity than required for the peak demand of the load 196. This is because the compressor runs essentially continuously and stores compressed gas in the reservoir 194 during times of off-peak load. During times of power demand in excess of the compressor capability, i.e. times of peak power consumption, the load draws on the stored compressed gas in the reservoir. The storage of isothermally compressed as in accordance with FIG. 11 thus conserves capital, in that it makes possible savings in the required compressor capacity, which generally is the most costly part of a power system.

The application of foam to thermodynamic processes and equipment has so far been described principally with reference to compression. However, as discussed above, the invention is applicable also to expansion. That is, the foam of a liquid with a compressed gas can be expanded. The foam liquid can control the temperature change of the gas during expansion to provide an essentially isothermal expansion, or the other temperature functions discussed above. Also, a compressed foam has many times the density of a gas alone, which can provide further advantages.

The essentially isothermal compression and isothermal expansion thus possible with this invention, combined with isentropic compression and expansion, make possible the practical realization of thermodynamic systems operating with near Carnot cycles.

The practice of isothermal expansion, or other temperture-controlled expansion, of a compressed gas in a liquid foam can be done following the foregoing teachings regarding compression of a liquid-gas foam. The foam can be separated into the liquid and gas constituents following expansion, and further work can be extracted from the separated gas where its pressure is still above atmospheric.

Figure 12:
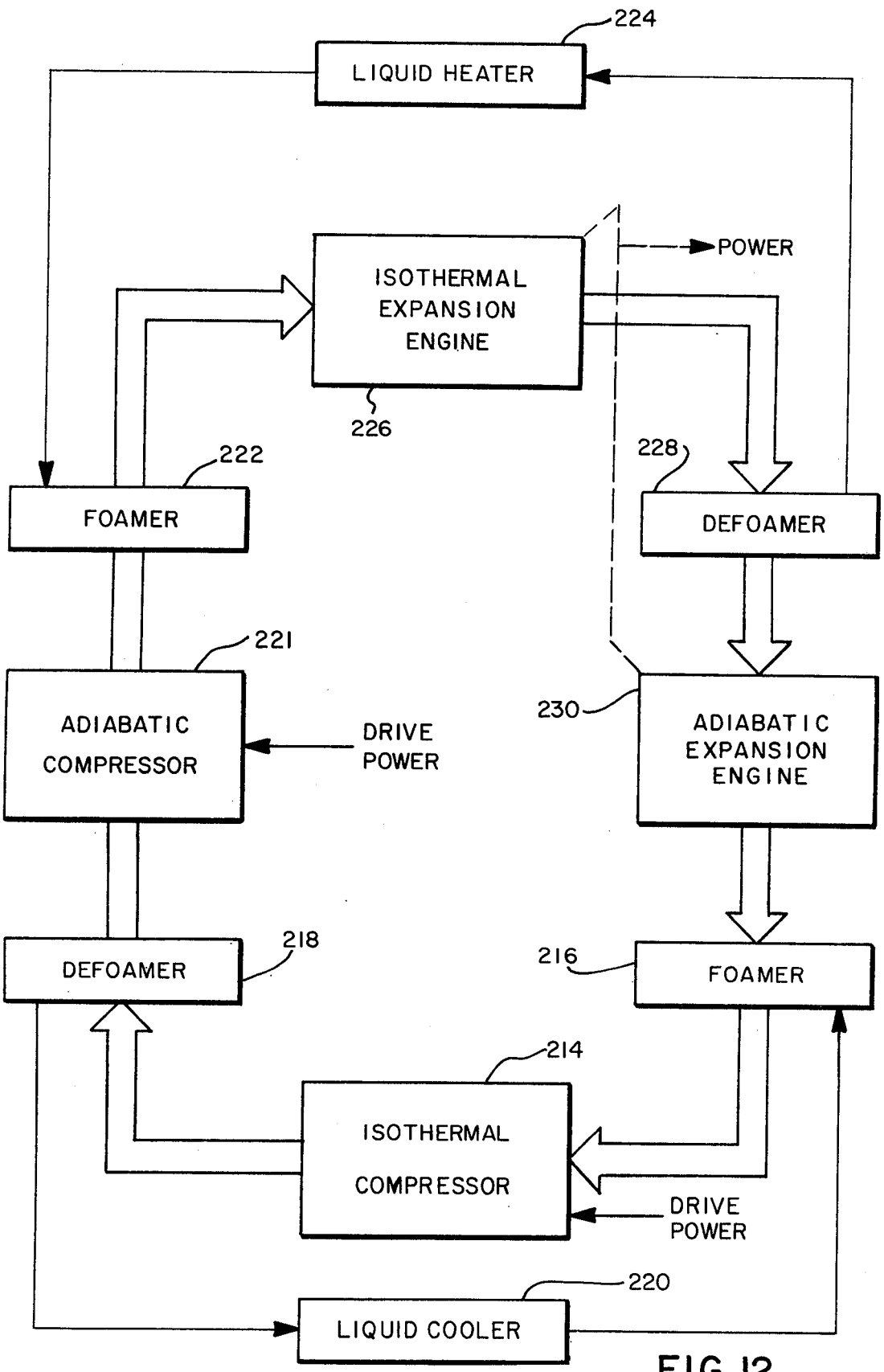
FIG. 12 is a schematic block diagram of a thermodynamic system capable of operation with a near Carnot cycle.

By way of illustrative example, FIG. 12 shows a thermodynamic system which approximates a true Carnot cycle (two isothermals connected by two isentropics). The system has a powered isothermal compressor 214 which compresses foamed working fluid received from a foamer 216. The compression is essentially isothermal, so that the working fluid remains at the initial temperature. A defoamer 218 separates the compressed fluid from the foam liquid, and a liquid cooler 220 recycles the liquid to the foamer after the desired cooling. These elements of the system can employ constructions as described above with reference to FIGS. 1-6.

A powered adiabatic compressor 221 further compresses the working fluid output from the defoamer 218. The resultant compressed fluid is now at an elevated temperature relative to its temperature in compressor 214. It is next foamed with a correspondingly hot foaming liquid in a foamer 222. A liquid heater 224 heats the liquid as desired; it preferably derives its heat from a heat source such as a nuclear reactor. That is, the heater 224 can utilize heat discharged from another thermal system.

The hot foam is next applied to drive an expansion engine 226, producing power. However, by virtue of the foamed state of the compressed working fluid, the expansion is essentially isothermal. A defoamer 228 separates the still-hot working fluid from the foaming liquid, and the latter fluid is recycled via the heater 224. An adibatic expansion engine 230 extracts further energy from the separated working fluid, producing further output power.

The reason the engine 230 can extract energy from the liquid after it has driven engine 226 is that the fluid is still at an elevated temperature, due to the near isothermal expansion in engine 226. The foamer 216 receives the spent working fluid, which is now fully expanded and cool.

This arrangement of a carnot-cycle system takes in heat at an elevated temperature at the liquid heater 224 and transfers it to the working fluid in the expansion engine 226. The system discharges heat at a significantly lower, typically ambient, temperature at the liquid cooler 220. Further, the system consumes power in compressors 214 and 221, but at least part of this can be supplied by the power which engines 226 and 230 produce.

The system of FIG. 12 can also operate in reverse, with the only basic change being that the foamers and defoamers are interchanged, ie. by replacing formers 216 and 222 with defoamers and replacing defoamers 218 and 228 with foamers. With this reverse operation, the system functions ideally as a Carnot refrigerator, with the liquid heater 224 cooling a thermal load. More specifically, in the reverse operation, unit 218 foams the working fluid and liquid at ambient temperature. Compressor 214 compresses the foam, and after defoaming in unit 216 the engine 230 expands the working fluid, thereby cooling it. The cooled fluid, after foaming in unit 228, is expanded essentially isothermally in engine 226. The liquid separated from the working fluid in unit 222 then absorbs heat from the thermal load in liquid heater 224, a pump can of course be employed to circulate the liquid in the heater, as well as in liquid cooler 220. The compressor 221 compresses the cool working fluid, raising its temperature back to ambient, after which the fluid is again foamed in unit 218.

It will thus be seen that the objects set forth above, among those made apparent from the preceding description, are efficiently attained. Since certain changes may be made in carrying out the above processes and in the constructions set forth without departing from the scope of the invention, it is intended that all matter contained in the above description or shown in the accompanying drawings shall be interpreted as illustrative and not in a limiting sense.

The following claims are intended to cover all of the generic and specific features of the invention herein described, and all statements of the scope of the invention which as a matter of language might be said to fall therebetween.

Having described the invention, what is claimed as new and secured by Letters Patent is:

1. A gas expansion engine apparatus comprising:

a first foaming unit for foaming a gas with a foamable liquid to provide a foam thereof, said foaming unit having an inlet arrangement and an outlet, said inlet arrangement including a first inlet conduit for introducing said gas to said first foaming unit and a second inlet conduit for introducing said foamable liquid to said first foaming unit, said outlet being adapted for withdrawal of said foam from said first foaming unit;

a first compressor having its inlet coupled to said outlet of said first foaming unit for receiving said foam therefrom and for compressing said foam from a first to a second pressure level to isothermally compress the gas contained in said foam from said first to said second pressure level;

a first defoaming unit having an inlet coupled to the outlet of said first compressor for receiving said foam therefrom and for separating said gas from said liquid of said foam while maintaining said separated gas at said second pressure level, said first defoaming unit having a gas outlet configured for independent withdrawal of said separated gas and a liquid outlet configured for independent withdrawal of said separated liquid;

a second compressor having its inlet coupled to said gas outlet of said first defoaming unit for receiving said separated gas therefrom and for compressing said gas to adiabatically raise the pressure thereof from said second level to a third level;

a second foaming unit coupled to the output of said second compressor for receiving said gas therefrom while maintaining said gas at said third pressure level and for foaming said received gas with a foamable liquid to provide a foam thereof, said second foaming unit having an inlet arrangement and an outlet, said inlet arrangement of said second foaming unit including a first inlet conduit for introducing said gas to said second foaming unit and a second inlet conduit for introducing said foamable liquid to said second foaming unit, said outlet being adapted for withdrawal of said foam from said second foaming unit;

a first expansion engine having a foam inlet and a foam outlet, said foam inlet of said first expansion engine being coupled to said output of said second foaming unit to receive said foam therefrom, said first expansion engine allowing said received foam to expand isothermally from said third level to an intermediate pressure level between said third and said first pressure levels to thereby produce engine output power, said gas contained in said foam expanding substantially isothermally;

a second defoaming unit having an inlet coupled to said foam outlet of said first expansion engine to receive said foam at said intermediate pressure level and for separating said gas from said liquid of said foam while maintaining said separated gas at said intermediate pressure level, said second defoaming unit having a gas outlet configured for withdrawal of said separated gas and a liquid outlet configured for withdrawal of said separated liquid; and a second expansion engine having a gas inlet and a gas outlet, said gas inlet of said second expansion engine being coupled to said gas outlet of said second defoaming unit to receive said separated gas therefrom at substantially said intermediate pressure, said second expansion engine allowing said received gas to expand adiabatically from said intermediate pressure level to a pressure level close to said first pressure level to thereby produce engine output power.

2. The apparatus of claim 1 additionally including a conduit coupled to said outlet of said second expansion engine for conducting gas from said second expansion engine to the first inlet of said first foaming unit for thereby recycling said gas through said apparatus.

3. The apparatus of claim 1 additionally including a conduit coupling said liquid outlet of said first defoaming unit to said second inlet of said first foaming unit for conducting said separated liquid from said first defoaming unit back to said inlet arrangement of said first foaming unit for foaming with said gas.

4. The apparatus of claim 3 wherein said conduit for conducting said separated liquid back to said first foaming unit includes a cooler unit for reducing the temperature of said separated liquid as it is returned to said first foaming unit.

5. The apparatus of claim 3 additionally including a conduit coupling said liquid outlet of said second defoaming unit to said second inlet of said second foaming unit for conducting said separated liquid from said second defoaming unit back to said inlet of said second foaming unit for foaming with said gas.

6. The apparatus of claim 5 wherein said conduit for conducting said separated liquid back to said first foaming unit includes a heater unit for increasing the temperature of said separated liquid as it is returned to said second foaming unit.

7. A process for producing work comprising the steps of:

mixing a gas with a foamable liquid to form a first foam;

compressing said foam to increase the pressure thereof from a first pressure level to a second, significantly higher pressure level thereby substantially isothermally compressing the gas contained in said foam from said first to said second pressure level;

then separating said gas from said liquid portion of said first foam while maintaining the separated gas and the separated liquid at said second pressure level;

thereafter independently withdrawing said separated gas and said separated liquid while maintaining said withdrawn gas at said second pressure level;

compressing said withdrawn gas to adiabatically raise the pressure thereof from said second level to a third level;

mixing said adiabatically compressed gas with a foamable liquid to form a second foam;

expanding said second foam to produce output work, said expanding step isothermally lowering the pressure of the gas contained in said second foam from said third pressure level to a pressure level intermediate said third and said first pressure level;

then separating the gas from the liquid of said second foam while maintaining said separated gas at said intermediate pressure level; and further expanding said gas separated from said second foam to produce additional output work.

* * * * *